US011278466B2

(12) United States Patent
Yoshida et al.

(10) Patent No.: US 11,278,466 B2
(45) Date of Patent: Mar. 22, 2022

(54) CONTROL METHOD FOR MASSAGE MACHINE AND MASSAGE ELEMENT OF MASSAGE MACHINE

(71) Applicant: FUJI MEDICAL INSTRUMENTS MFG. CO., LTD., Osaka (JP)

(72) Inventors: Toshihisa Yoshida, Osaka (JP); Nobukazu Kawagoe, Osaka (JP)

(73) Assignee: FUJI MEDICAL INSTRUMENTS MFG. CO., LTD., Osaka (JP)

( * ) Notice: Subject to any disclaimer, the term of this patent is extended or adjusted under 35 U.S.C. 154(b) by 734 days.

(21) Appl. No.: 15/446,890

(22) Filed: Mar. 1, 2017

(65) Prior Publication Data

US 2017/0281455 A1 Oct. 5, 2017

(30) Foreign Application Priority Data

Mar. 31, 2016 (JP) ..... JP2016-070658

(51) Int. Cl.
*A61H 7/00* (2006.01)

(52) U.S. Cl.
CPC ..... *A61H 7/007* (2013.01); *A61H 2201/0149* (2013.01); *A61H 2201/0192* (2013.01);
(Continued)

(58) Field of Classification Search
CPC ..... A61H 7/007; A61H 2015/0007; A61H 15/0078; A61H 2201/018;
(Continued)

(56) References Cited

U.S. PATENT DOCUMENTS 5,792,080 A * 8/1998 Ookawa ..... A61H 1/00 601/102
6,190,339 B1 * 2/2001 Imazaike ..... A61H 7/005 601/133

(Continued)

FOREIGN PATENT DOCUMENTS

JP 1993137762 A 6/1993
JP 2001-087332 A 4/2001

(Continued)

OTHER PUBLICATIONS

Chinese Office Action dated Nov. 5, 2019, Chinese Application No. 201611236787.7, 29 Pages.

(Continued)

*Primary Examiner* — Tu A Vo
*Assistant Examiner* — Alexander Morales
(74) *Attorney, Agent, or Firm* — Masuvalley & Partners

(57) ABSTRACT

A primary object of the present invention is to provide a control method for a massage machine and a massage element of a massage machine which can provide pressing and rubbing kneading to a person to be treated. A control method for a massage machine contains a controlling process for individually controlling operations of a kneading motor 331 for operating a pair of massage elements 321, 322, width adjustment motors 341, 342 for adjusting a width between the pair of massage elements 321, 322, a strength-and-weakness motor 351 for adjusting strength of the pair of massage elements 321, 322 and an up-and-down motor 361 for adjusting movement of the pair of massage elements 321, 322 in an up-and-down direction.

5 Claims, 16 Drawing Sheets

(52) U.S. Cl.
CPC ..... *A61H 2201/1215* (2013.01); *A61H 2201/164* (2013.01); *A61H 2201/169* (2013.01); *A61H 2201/1623* (2013.01); *A61H 2201/1645* (2013.01); *A61H 2201/1654* (2013.01); *A61H 2201/50* (2013.01); *A61H 2201/5002* (2013.01); *A61H 2201/5023* (2013.01); *A61H 2203/0425* (2013.01); *A61H 2205/081* (2013.01)

(58) Field of Classification Search
CPC .... A61H 2201/1463; A61H 2201/1657; A61H 2201/5002; A61H 2201/5035; A61H 2201/0149; A61H 2201/0192; A61H 2201/1207; A61H 2201/1623; A61H 2201/164; A61H 2201/1645; A61H 2201/1654; A61H 2201/169; A61H 2201/50; A61H 2201/5023; A61H 2203/0425
See application file for complete search history.

(56) References Cited

U.S. PATENT DOCUMENTS 6,224,563 B1 * 5/2001 Nonoue ..... A61H 15/0078 601/99
6,832,991 B1 * 12/2004 Inada ..... A61H 15/0078 601/99
7,429,251 B2 * 9/2008 Tanizawa ..... A61H 7/00 601/100
7,494,475 B2 * 2/2009 Morita ..... A61H 7/00 601/102
7,892,192 B2 * 2/2011 Tsukada ..... A61H 7/007 601/102
2005/0010144 A1 * 1/2005 Chen ..... A61H 7/007 601/99
2005/0090770 A1 * 4/2005 Chen ..... A61H 15/0078 601/99
2007/0149907 A1 * 6/2007 Ting ..... A61H 15/0078 601/99
2007/0299377 A1 * 12/2007 Shiraishi ..... A61H 7/007 601/98
2008/0200853 A1 * 8/2008 Tielve ..... A61H 1/0292 601/134
2008/0312569 A1 * 12/2008 Chen ..... A61H 7/007 601/134
2009/0149785 A1 * 6/2009 Canto Garcia ..... A61H 7/007 601/99
2011/0275968 A1 * 11/2011 Liu ..... A61H 7/007 601/134
2014/0024983 A1 * 1/2014 Numata ..... A61H 7/007 601/99
2015/0216759 A1 * 8/2015 Tamaki ..... A61H 15/0078 601/134

FOREIGN PATENT DOCUMENTS

JP 2003-024402 A 1/2003
JP 2003-275270 A 9/2003
JP 2008029426 A 2/2008
JP 2013-153969 A 8/2013

OTHER PUBLICATIONS

Japanese Office Action dated Nov. 12, 2019, Japanese Application No. 2016-070658, 6 Pages.
Japanese office Action dated Jun. 11, 2020 in Japanese Application No. 2016-070658, 5 pages with translation.

* cited by examiner

CONTROL METHOD FOR MASSAGE MACHINE AND MASSAGE ELEMENT OF MASSAGE MACHINE

This application claims priority under 35 U.S.C. § 119 to Japanese patent application Serial No. 2016-070658, filed Mar. 31, 2016, which is incorporated herein by reference in its entirety.

FIELD OF INVENTION

The present invention relates to a control method for a massage machine and a massage element of a massage machine.

BACKGROUND OF THE INVENTION

There is a massage machine for making a massage unit compact.

Also, there is a massage machine which can perform a beating operation in which a beating width is automatically changed when massage elements are moved up and down while performing the beating operation, and a width between the massage elements are not changed more than necessary.

SUMMARY OF THE INVENTION

A control method for a massage machine according to one aspect comprises a controlling step for individually controlling operations of a kneading motor for eccentrically and pivotally moving a pair of massage elements of the massage machine, a width adjustment motor for adjusting a width between the pair of massage elements, a strength-and-weakness motor for adjusting front-back movement of the pair of massage elements and an up-and-down motor for adjusting up-and-down movement of the pair of massage elements. The controlling step operates the massage elements so that movement of the massage elements in a width direction thereof due to the width adjustment motor is directed to a reverse direction with respect to movement of the massage elements in the width direction thereof due to the kneading motor, movement of the massage elements in a front-back direction due to the strength-and-weakness motor is directed to a reverse direction with respect to movement of the massage elements in the front-back direction due to the kneading motor, and movement of the massage elements in an up-and-down direction due to the up-and-down motor is directed to a reverse direction with respect to movement of the massage elements in the up-and-down direction due to the kneading motor.

A massage element of a massage machine according to yet another present invention comprises a massage element constituted of a rod-like member having a size approximated to a size of a finger of a human.

In this case, the massage element is constituted of not a member having an oval spherical shape or a circular spherical shape, which is a common massage ball, but the rod-like member having the size approximated to the size of a finger of a human. Specifically, the size of the rod-like member is preferably equal to a size of a thumb or an index finger of a human. Specifically, it is more preferable that the rod-like member has a curved shape of a ball of a finger whose tip end portion has a size of 5 cm or less or a curved shape of a ball of a finger whose tip end portion has a size of 3 cm or less. Further, the rod-like member may contain a semi-spherical body whose tip end portion has a size of ϕ3 cm or less. Further, the rod-like member may have a massage rod shape used for pressing a sole of a foot and it is preferable that a length of the rod-like member is equal to a diameter of the oval spherical shape or the spherical shape of the massage ball.

In this case, when the one of the plural kinds of the massage elements is selected, the actuator is driven to pivotally move the massage element connecting member in the one direction. On the other hand, when the other one of the plural kinds of the massage elements is selected, the actuator is driven to pivotally move the massage element connecting member in the direction opposite to the one direction. As a result, it is possible to select one of the plural kinds of massage elements to provide the massage to the person to be treated. Thus, the person to be treated can select numerous variations of massages.

DETAILED DESCRIPTION OF THE PREFERRED EMBODIMENT

Figure 1:
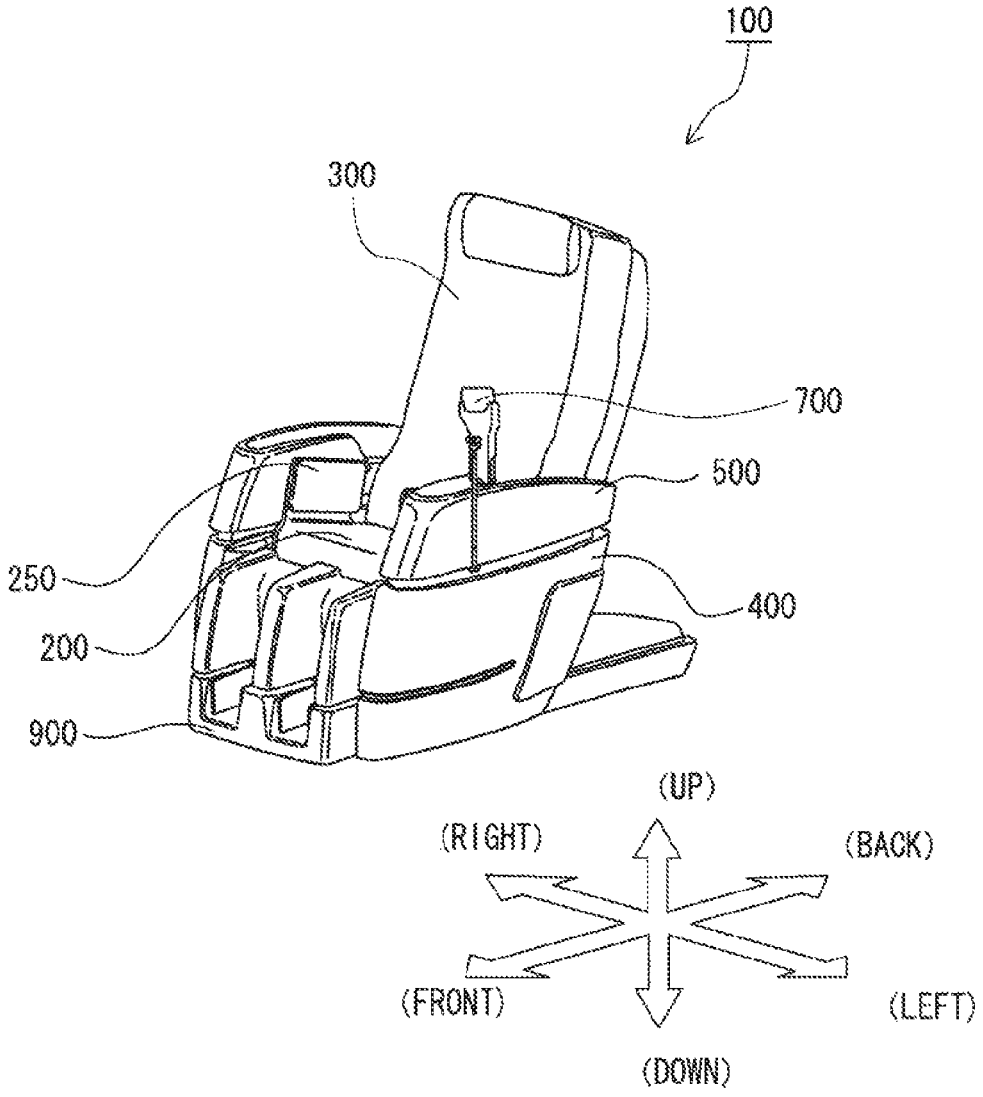
FIG. 1 is a perspective view showing a configuration of a seat-type massage machine according to an embodiment of the present invention.

Hereinafter, embodiments of the present invention will be described in detail with reference to the accompanying drawings. In this regard, the same numbers are used throughout the drawings to reference the same objects or the equivalent objects and description for the same objects or the equivalent objects is not repeated. For ease of explanation, configurations are shown in the drawings referenced in the following description in a simplified or schematized manner and/or some of configuration members are omitted in the drawings. Further, a dimensional ratio among the configuration members shown in each drawing does not necessarily indicate an actual dimensional ratio.

Embodiment

FIG. 1 is a perspective view showing a configuration of a seat-type massage machine 100 according to an embodiment of the present invention. As shown in FIG. 1, the seat-type massage machine 100 according to the embodiment of the present invention includes a seat portion 200, a waist air bag portion 250, a backrest portion 300, a base portion 400, arm treatment portions 500, an operation part 700, a control part 800 and a leg placing portion 900.

In this regard, in the following description for the massage machine 100, as shown in FIG. 1, the side on which the backrest portion 300 is formed on the seat portion 200 is assumed as a back side (BACK), the side opposed to the back side (BACK) is assumed as a front side (FRONT), each of a left side (LEFT) and a right side (RIGHT) is assumed and each of an upside (UP) and a down side (DOWN) is assumed.

As shown in FIG. 1, the backrest portion 300 of the seat-type massage machine 100 is formed so that the backrest portion 300 can support a shoulder, a waist and a back of the person to be treated and can be erected and tilted in the front-back direction. Further, a massage unit 310 (see FIG. 2) is provided at the backrest portion 300. Massage elements (a pair of massage balls) are provided in the massage unit 310. Further, the massage unit 310 is provided in the backrest portion 300 so that the massage unit 310 can be moved in the up-and-down direction (vertical direction) along a guide rail. The massage elements are constituted of the pair of massage balls so as to be capable of providing a variety of treatment operations such as a kneading operation, a beating operation and a rolling operation. Details of the massage unit 310 will be described later.

Next, one or more expansion and contraction bags (air treatment portions) which can repeatedly expand are provided in the waist air bag portion 250 provided to stand on the seat portion 200 shown in FIG. 1. The waist air bag portion 250 provides treatment to a hip of the person to be treated with supporting the hip of the person to be treated by using the one or more expansion and contraction bags. Further, the leg placing portion 900 is axially supported at front ends of the seat portion 200 and the base portion 400, and is provided so that the leg placing portion 900 itself can be pivotally moved. One or more expansion and contraction bags, which can repeatedly expand and are the same as those of the waist air bag portion 250, are provided in the leg placing portion 900. The leg placing portion 900 provides treatment to legs of the person to be treated by using the expansion and contraction bags.

Further, the arm treatment portions 500 are respectively provided to stand on the left and right sides on the seat portion 200 shown in FIG. 1. One or more expansion and contraction bags, which can repeatedly expand and are the same as those of the waist air bag portion 250, are provided in each of the arm treatment portions 500. Each of the arm treatment portions 500 provides treatment to each arm of the person to be treated with supporting each arm of the person to be treated by using the expansion and contraction bags.

Finally, the control part 800 is provided inside the base portion 400. Further, the control part 800 performs processes described below in response to operations of the operation part 700.

Next, description will be given to the massage unit 310 and then description will be given to a control method for the massage elements (the pair of massage balls) provided in the massage unit 310.

Figure 2:
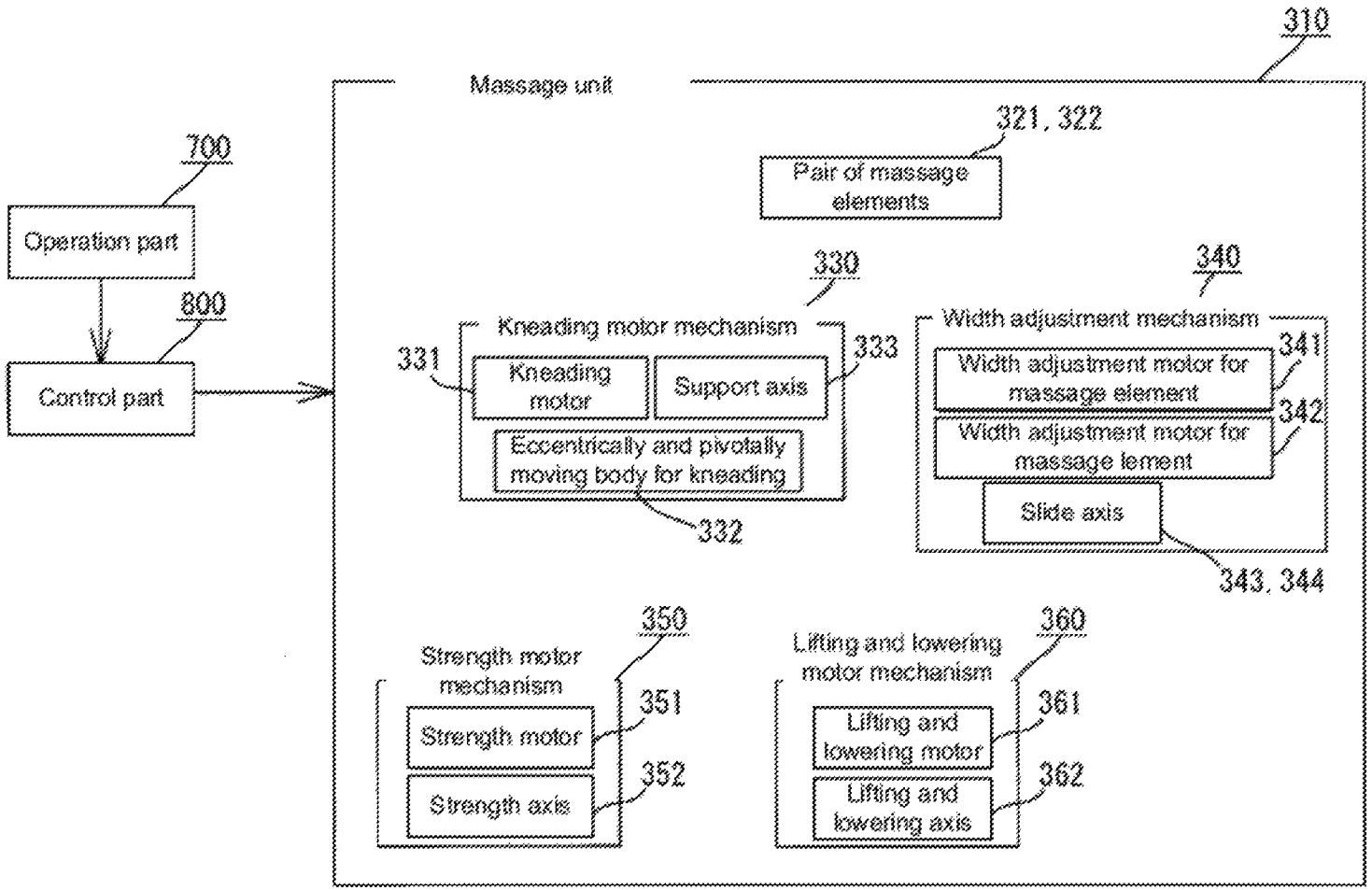
FIG. 2 is a schematic view showing one example of a configuration of a massage unit.

FIG. 2 is a schematic view showing one example of a configuration of the massage unit 310. In this regard, although the massage unit 310 is exemplified in this embodiment, the present invention is not limited thereto. The massage unit 310 may not be unitized.

The massage unit 310 shown in FIG. 2 mainly includes a pair of massage elements 321, 322, a kneading motor mechanism 330, a width adjustment mechanism 340, a strength-and-weakness motor mechanism 350 and a up-and-down motor mechanism 360. As shown in FIG. 2, the massage unit 310 operates according to instructions from the control part 800 responding to the operations of the operation part 700. Thus, the control part 800 individually controls operations of the kneading motor mechanism 330, the width adjustment mechanism 340, the strength-and-weakness motor mechanism 350 and the up-and-down motor mechanism 360. In this regard, although the massage unit 310 of the seat-type massage machine 100 according to this embodiment includes a beating motor mechanism, description for the beating motor mechanism is omitted because the beating motor mechanism is not controlled in the present invention.

(Kneading Motor Mechanism)

The kneading motor mechanism 330 includes a kneading motor 331, eccentrically and pivotally moving bodies 332 for kneading and a support axis 333. As a result, when the kneading motor 331 is driven, the pair of massage elements 321, 322 are eccentrically and pivotally moved in the front-back direction by the eccentrically and pivotally moving bodies 332 provided on the support axis 333 to perform a kneading operation. As a result, the massage elements are eccentrically and pivotally moved in the front-back direction. Thus, the kneading operation contains all of movement in the up-and-down direction, movement in the front-back direction and movement in the left-right direction and this results in that an abutting angle of the massage elements (the massage balls) with respect to the body is also changed. Details of the kneading operation will be described below.

(Width Adjustment Mechanism)

The width adjustment mechanism 340 includes a width adjustment motor 341 for the massage element 321, a width adjustment motor 342 for the massage element 322 and slide axes 343, 344. As a result, when the width adjustment motor 341 for the massage element 321 normally rotates, the massage element 321 is moved toward the left direction. On the other hand, when the width adjustment motor 341 for the massage element 321 reversely rotates, the massage element 321 is moved toward the right direction. Further, when the width adjustment motor 342 for the massage element 322 normally rotates, the massage element 322 is moved toward the right direction. On the other hand, when the width adjustment motor 342 for the massage element 322 reversely rotates, the massage element 322 is moved toward the left direction.

By individually rotating the width adjustment motor 341 for the massage element 321 and the width adjustment motor 342 for the massage element 322 as described above, it is possible to change an absolute position of each of the massage elements 321, 322, thereby changing a width between the massage elements 321, 322.

As a result, it is possible to change the width between the pair of massage elements. Thus, it is possible to change the positions of the pair of massage elements to be contacted with the back of the person to be treated, thereby providing treatment matching preference of the person to be treated.

(Strength-and-Weakness Motor Mechanism)

The strength-and-weakness motor mechanism 350 includes a strength-and-weakness motor 351 and a strength-and-weakness axis 352. The strength-and-weakness motor 351 can move the pair of massage elements 321, 322 in the front-back direction through the strength-and-weakness axis 352 and a pinion gear (not shown in the drawings). Namely, the pair of massage elements 321, 322 are moved toward the front side when the strength-and-weakness motor 351 normally rotates and the pair of massage elements 321, 322 are moved toward the back side when the strength-and-weakness motor 351 reversely rotates. In this regard, the strength-and-weakness motor 351 can adjust the movement of the pair of massage elements 321, 322 in the front-back direction in not two stages but multiple stages. As a result, it is possible to provide a massage in which the pair of massage elements 321, 322 are pressed onto to the back of the person to be treated with high pressure by moving the pair of massage elements 321, 322 toward the front side. Further, it is possible to provide a massage in which the pair of massage elements 321, 322 are pressed onto the back of the person to be treated with low pressure by moving the pair of massage elements 321, 322 toward the back side.

(Up-and-Down Motor Mechanism)

Next, the up-and-down motor mechanism 360 includes an up-and-down motor 361 and an up-and-down axis 362. When the up-and-down motor 361 normally rotates, the up-and-down axis 362 is rotated and this rotation is transmitted to the pinion gear and a rack (not shown in the drawings). This allows the massage unit 310 to be moved toward the upper direction. Further, when the up-and-down motor 361 reversely rotates, the up-and-down axis 362 is rotated and this rotation is transmitted to the pinion gear and the rack (not shown in the drawings). This allows the massage unit 310 to be moved toward the lower direction. As a result, it is possible to move the pair of massage elements 321, 322 in one of the upper and lower directions. Thus, it is possible to massage an upper portion of the back of the person to be treated by moving the pair of massage elements 321, 322 toward the upper direction and it is possible to massage a lower portion of the back or the waist of the person to be treated by moving the pair of massage elements 321, 322 toward the lower direction.

Figure 3:
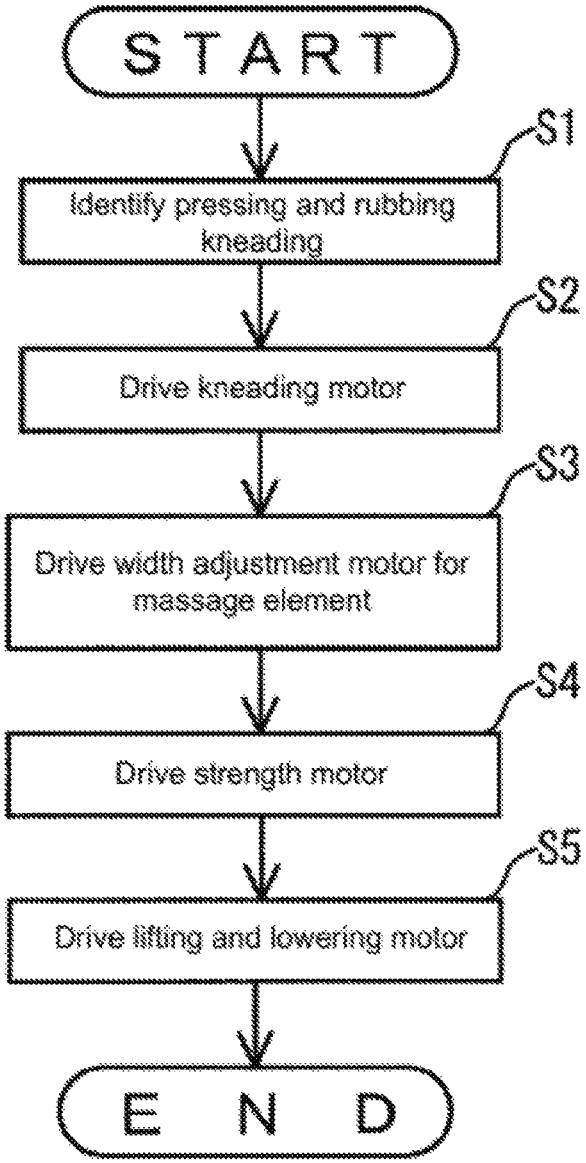
FIG. 3 is a flow chart showing one example of control of a control part for practicing pressing and rubbing kneading.

Subsequently, description will be given to operations of the control part 800 in this embodiment. FIG. 3 is a flow chart showing one example of control of the control part 800 for practicing the pressing and rubbing kneading. Each of FIGS. 4 and 6 to 8 is a schematic view showing each operation of the kneading motor 331, the width adjustment motor 341 for the massage element 321, the width adjustment motor 342 for the massage element 322, the strength-and-weakness motor 351 and the up-and-down motor 361 (hereinafter, these motors are referred to as four motors in brief). Further, FIG. 5 is a schematic view showing one example of a moving locus of the massage elements 321, 322 in the case where only the kneading motor 331 is operated. Each operation shown in FIGS. 4 and 6 to 8 is obtained by measuring a moving distance in each direction of the up-and-down direction, the left-right direction and the front-back direction by an encoder (not shown in the drawings).

Figure 4A:
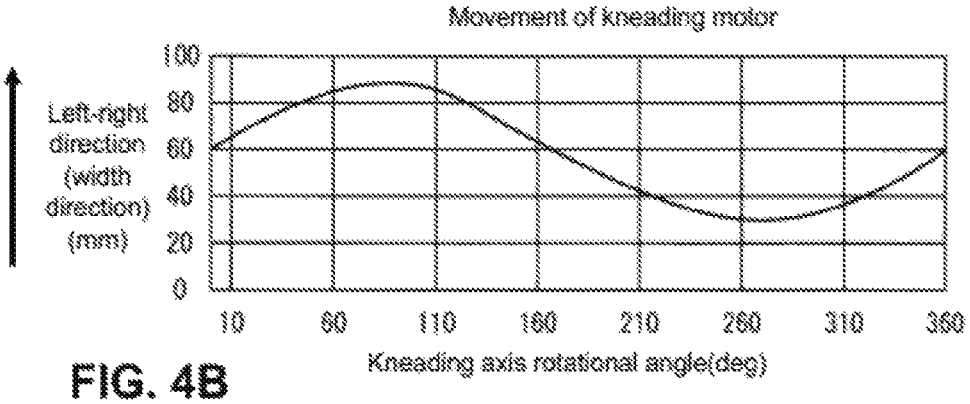
FIG. 4A through FIG. 4C are schematic view showing operations of a kneading motor.
Figure 4B:
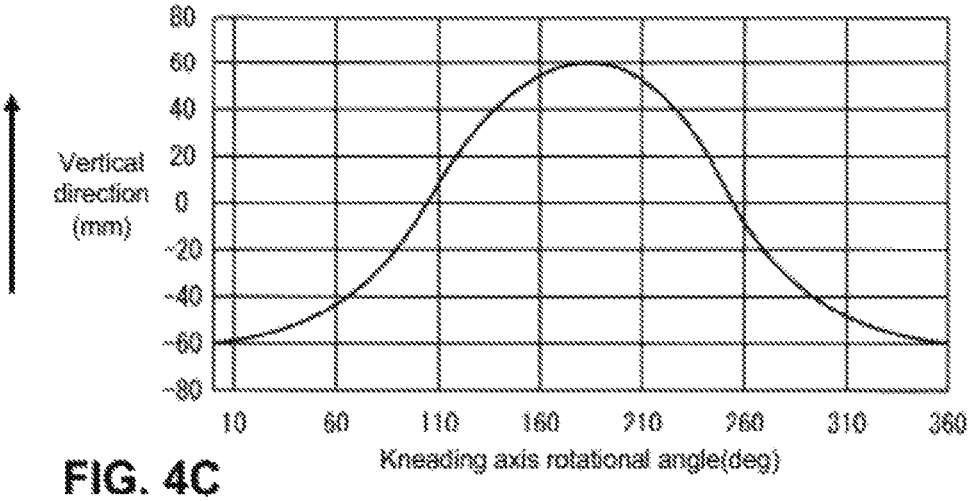
Figure 4C:
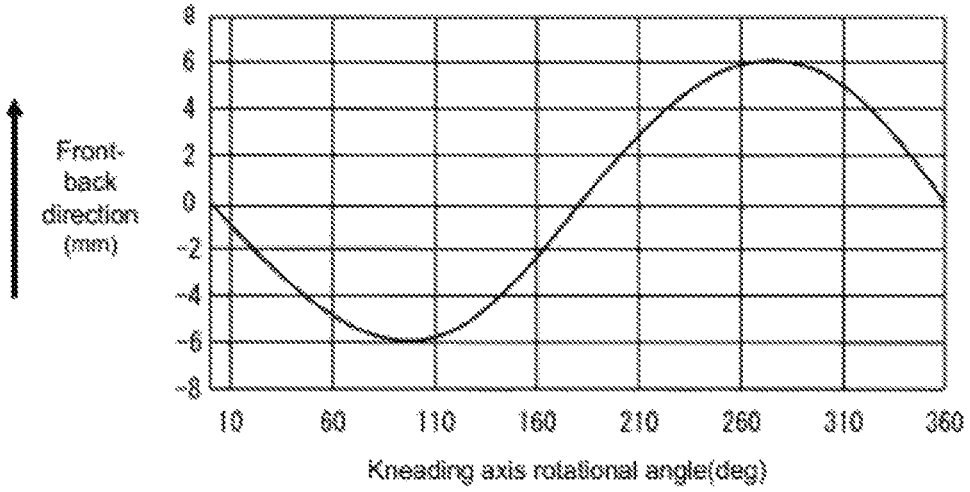
Figure 5:
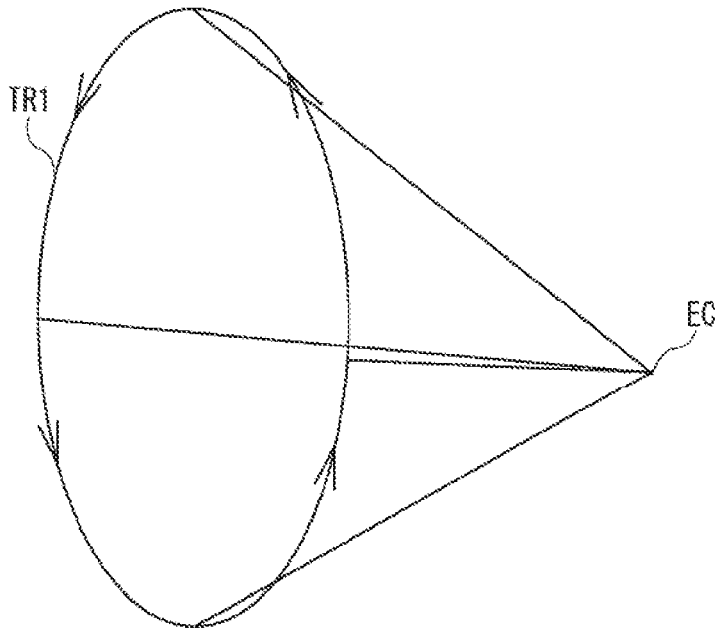
FIG. 5 is a schematic view showing one example of a moving locus of massage elements in the case where only the kneading motor is operated.
Figure 6A:
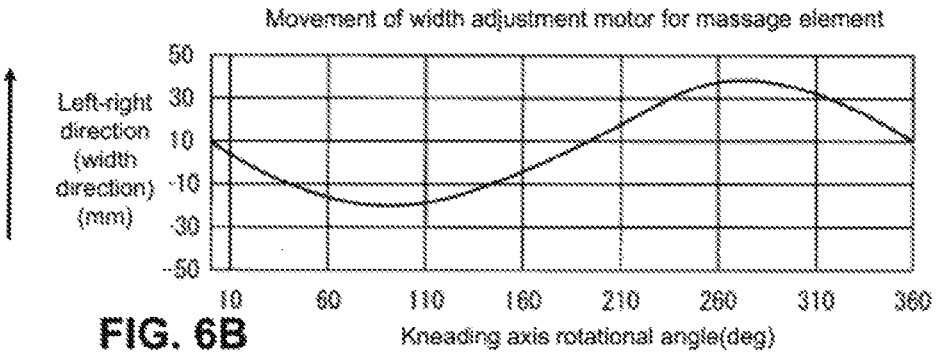
FIG. 6A through FIG. 6C are schematic view showing each operation of a width adjustment motor for the massage elements.
Figure 6B:
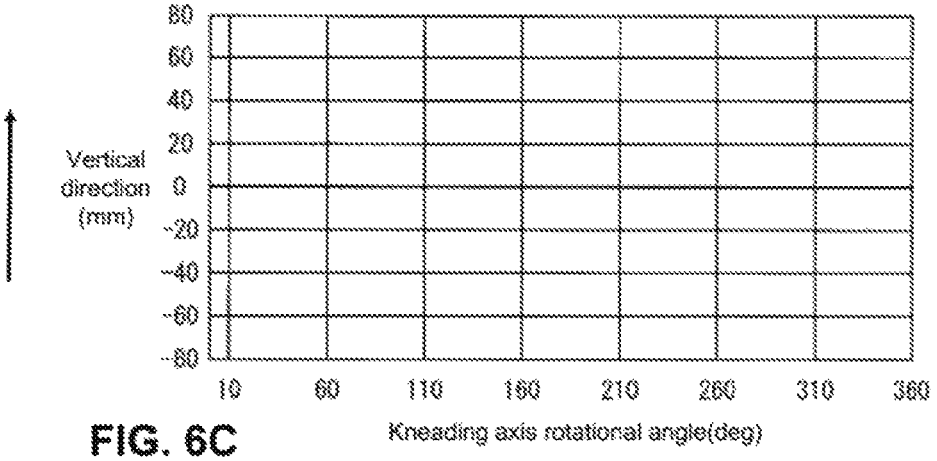
Figure 6C:
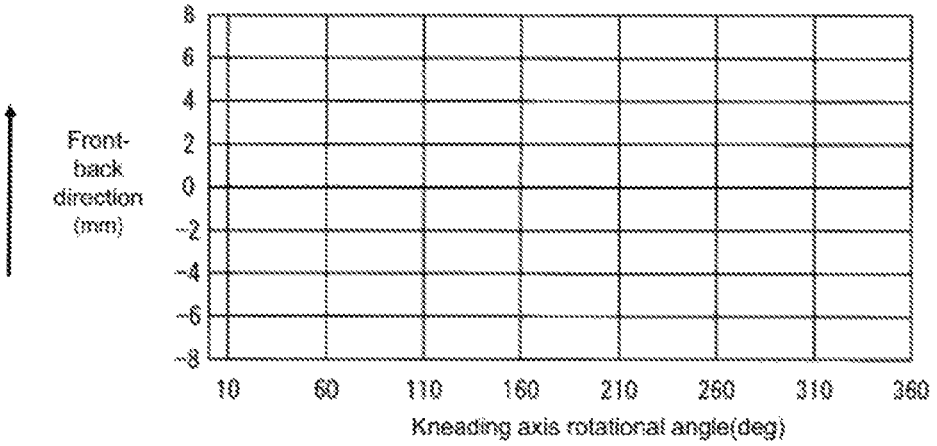
Figure 7A:
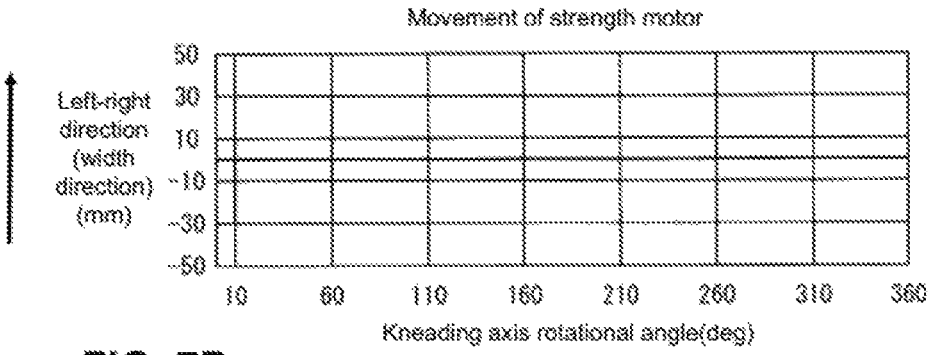
FIG. 7A through FIG. 7C are schematic view showing each operation of a strength-and-weakness motor.
Figure 7B:
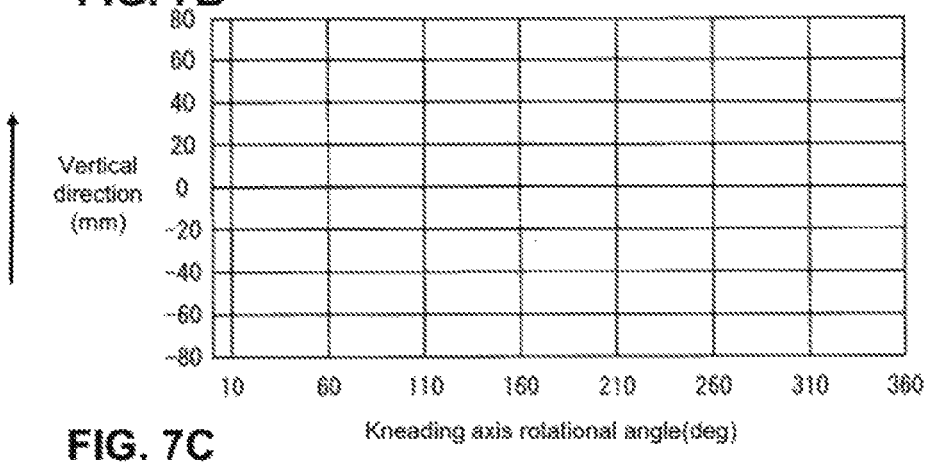
Figure 7C:
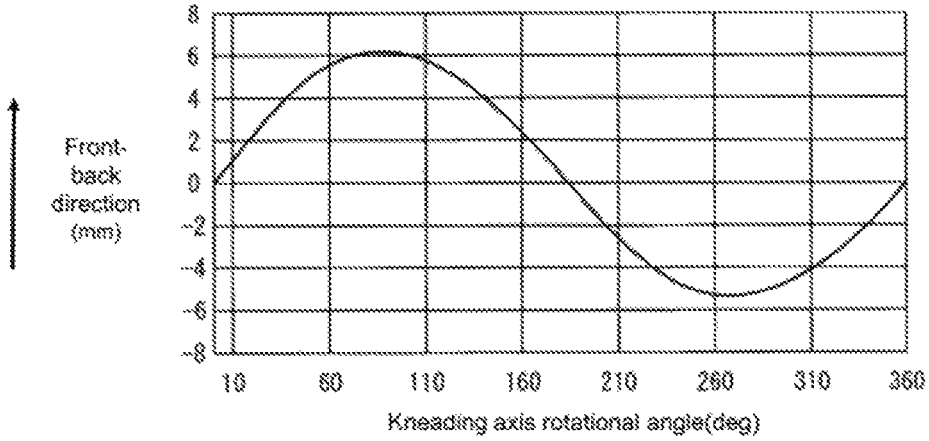
Figure 8A:
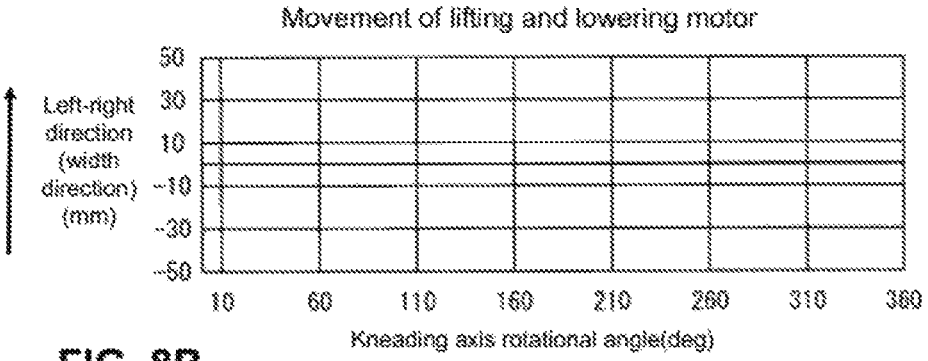
FIG. 8A through FIG. 8C are schematic view showing each operation of an up-and-down motor.
Figure 8B:
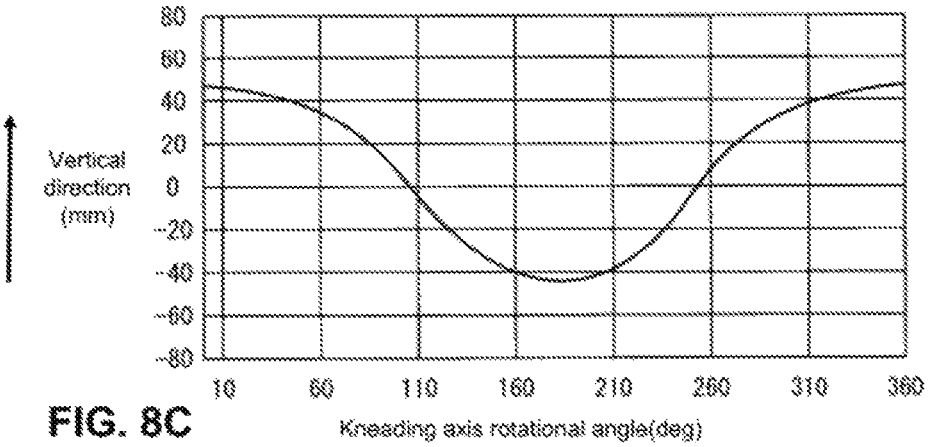
Figure 8C:
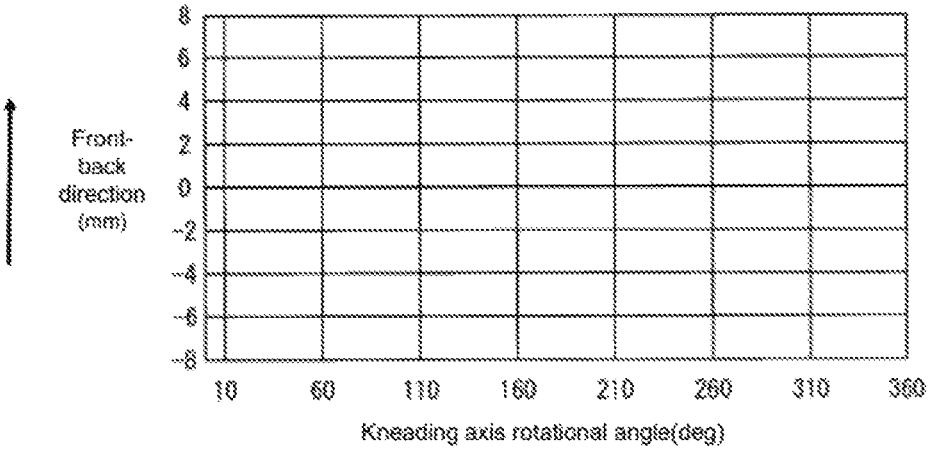

Here, FIG. 4A through FIG. 4C show one example of operations of the kneading motor 331. FIG. 6A through FIG. 6C show one example of operations of the width adjustment motor 341 for the massage element 321 and the width adjustment motor 342 for the massage element 322. FIG. 7A through FIG. 7C show one example of operations of the strength-and-weakness motor 351. FIG. 8A through FIG. 8C show one example of operations of the up-and-down motor 361. In this regard, each of FIGS. 4A and 6A to 8A shows an operation in the left-right direction. Each of FIGS. 4B and 6B to 8B shows an operation in the up-and-down direction. Each of FIGS. 4C and 6C to 8C shows an operation in the front-back direction.

(Pressing and Rubbing Kneading Flow Chart)

First, as shown in FIG. 3, the person to be treated uses a remote control device of the operation part 700 to select the "pressing and rubbing kneading". As a result, the control part 800 identifies the "pressing and rubbing kneading" (step S1).

Next, the control part 800 drives the kneading motor 331 (step S2). When the kneading motor 331 is driven, the pair of massage elements 321, 322 are moved in each direction of the up-and-down direction, the left-right direction and the front-back direction as shown in FIG. 4A through FIG. 4C. Specifically, the massage elements 321, 322 are moved in the left-right direction as shown in FIG. 4A, in the up-and-down direction as shown in FIG. 4B and in the front-back direction as shown in FIG. 4C. Namely, as shown in FIG. 5, in the case where only the kneading motor 331 is driven, a center between the massage elements 321, 322 is moved with respect to a center EC of the eccentric pivot operation of the massage elements 321, 322 in all directions of the left-right direction, the up-and-down direction and the front-back direction as indicated as a moving locus TR1. Namely, the abutting angle with respect to the body of the person to be treated is changed along with the movement (the ellipse locus TR1) of the massage elements (massage balls) 321, 322 due to the operation of the kneading motor 331 so as to be directed toward the outer side of the ellipse locus TR1. The language of "the outer side of the ellipse locus TR1" means a direction for pressing and stretching a treated part of the body of the person to be treated.

Next, the control part 800 drives the width adjustment motor 341 for the massage element 321 and the width adjustment motor 342 for the massage element 322 (step S3). In the case where the width adjustment motor 341 for the massage element 321 and the width adjustment motor 342 for the massage element 322 are driven, whereas the movement of pair of massage elements 321, 322 are changed in the left-right direction as shown in FIG. 6A by an effect of only the width adjustment motor 341 for the massage element 321 and the width adjustment motor 342 for the massage element 322, the movement of pair of massage elements 321, 322 are not changed in the up-and-down direction as shown in FIG. 6B and the front-back direction as shown in FIG. 6C. Thus, in this embodiment, the control part 800 drives the width adjustment motor 341 for the massage element 321 and the width adjustment motor 342 for the massage element 322 as shown in FIG. 6A to operate the pair of massage elements 321, 322 so that a change of the movement of pair of massage elements 321, 322 in the left-right direction becomes an opposite phase with respect to a phase of the change in the left-right direction shown in FIG. 4A. Further, magnitude of amplitude of the opposite phase due to the drive of the width adjustment motor 341 for the massage element 321 and the width adjustment motor 342 for the massage element 322 is preferably in the range of not less than 50% and not more than 90% of magnitude of amplitude of the change in the left-right direction shown in FIG. 4A. Further, the magnitude of the amplitude of the opposite phase is more preferably in the range of not less than 70% and not more than 85% of the magnitude of the amplitude of the change in the left-right direction shown in FIG. 4A.

Subsequently, the control part 800 drives the strength-and-weakness motor 351 (step S4). In the case where the strength-and-weakness motor 351 is driven, whereas the movement of pair of massage elements 321, 322 are changed in the front-back direction as shown in FIG. 7C by an effect of only the strength-and-weakness motor 351, the movement of pair of massage elements 321, 322 are not changed in the left-right direction as shown in FIG. 7A and in the up-and-down direction as shown in FIG. 7B. Thus, in this embodiment, the control part 800 drives the strength-and-weakness motor 351 as shown in FIG. 7C to operate the pair of massage elements 321, 322 so that a change of the movement of pair of massage elements 321, 322 in the front-back direction becomes an opposite phase with respect to a phase of the change in the front-back direction shown in FIG. 4C. Further, magnitude of amplitude of the opposite phase due to the drive of the strength-and-weakness motor 351 is preferably in the range of not less than 50% and not more than 100% of magnitude of amplitude of the change in the front-back direction shown in FIG. 4C. Further, the magnitude of the amplitude of the opposite phase is more preferably in the range of not less than 70% and not more than 100% of the magnitude of the amplitude of the change in the front-back direction shown in FIG. 4C. In this embodiment, the magnitude of the amplitude of the opposite phase is controlled so as to be equal to 100% of the magnitude of the amplitude of the change in the front-back direction shown in FIG. 4C.

Finally, the control part 800 drives the up-and-down motor 361 (step S5). In the case where the up-and-down motor 361 is driven, whereas the movement of pair of massage elements 321, 322 are changed in the up-and-down direction as shown in FIG. 8B by an effect of only the up-and-down motor 361, the movement of pair of massage elements 321, 322 are not changed in the left-right direction as shown in FIG. 8A and in the front-back direction shown in FIG. 8C. Thus, in this embodiment, the control part 800 drives the up-and-down motor 361 as shown in FIG. 8B to operate the pair of massage elements 321, 322 so that a change of the movement of pair of massage elements 321, 322 in the up-and-down direction becomes an opposite phase with respect to a phase of the change in the up-and-down direction shown in FIG. 4B. Further, magnitude of amplitude of the opposite phase due to the drive of the up-and-down motor 361 is preferably in the range of not less than 50% and not more than 90% of magnitude of amplitude of the change in the up-and-down direction shown in FIG. 4B. Further, the magnitude of the amplitude of the opposite phase is more preferably in the range of not less than 70% and not more than 85% of the magnitude of the amplitude of the change in the up-and-down direction shown in FIG. 4B.

In this regard, although the processes from the process of the step S2 to the process of the step S5 are performed in sequence according to the described flow chart, the present invention is not limited thereto. It is preferable that the control part 800 simultaneously performs the processes from the process of the step S2 to the process of the step S5. Further, it may be possible to change the sequential order for the processes from the process of the step S2 to the process of the step S5 and perform the processes according to the changed sequential order. In this case, it is preferable that the processes from the process of the step S2 to the process of the step S5 are performed within a level of a time duration which does not give a feeling of strangeness to the person to be treated. For example, it is preferable to perform the processes within 2 seconds, and it is more preferable to perform the processes within 0.1 seconds.

(Operation Explanation for Pressing and Rubbing Kneading)

Figure 9A:
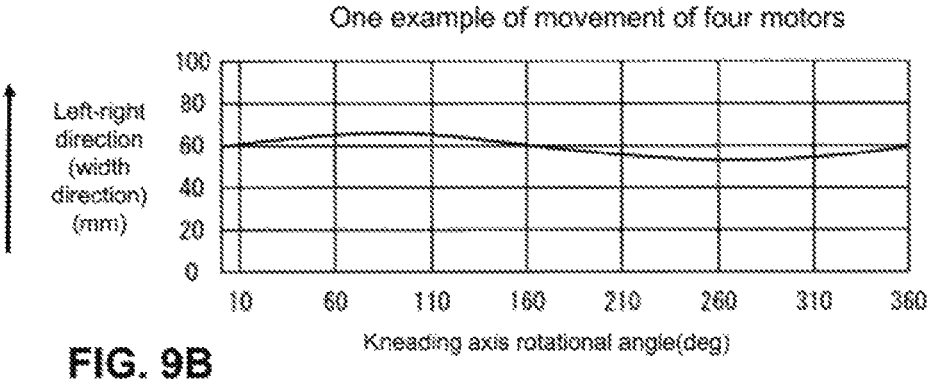
FIG. 9A through FIG. 9C are schematic view showing one example of operations provided by combining each operation of four motors.
Figure 9B:
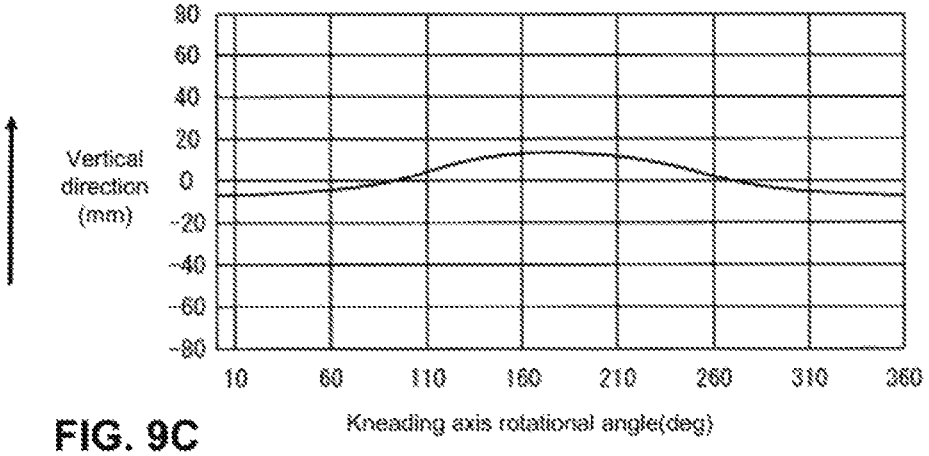
Figure 9C:
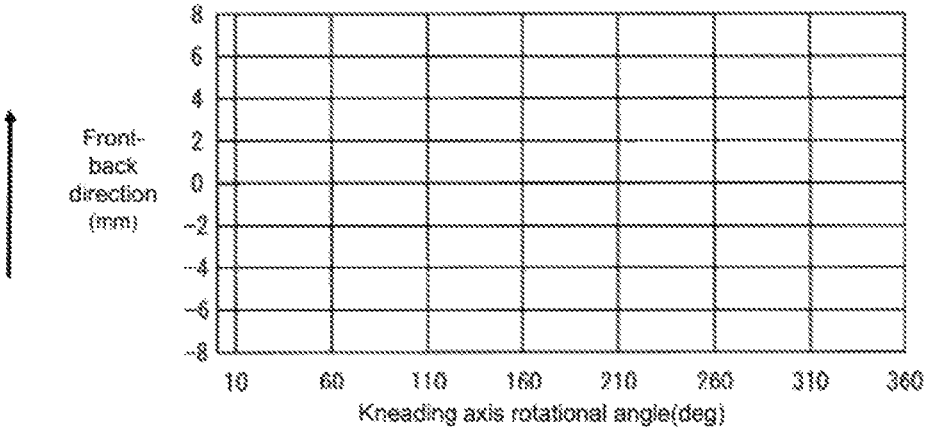

Subsequently, FIG. 9A through FIG. 9C are schematic view showing one example of operations provided by combining each operation of the four motors. Namely, FIG. 9 A through FIG. 9C show one example of the operations in the case where the pair of massage elements 321, 322 are operated according to the flow chart shown in FIG. 3. Further, FIG. 9A shows an operation in the left-right direction. FIG. 9B shows an operation in the up-and-down direction. FIG. 9C shows an operation in the front-back direction.

In this embodiment, in the case of combining each operation of the four motors in the left-right direction, it is possible to reduce magnitude of the operation of the pair of massage elements 321, 322 in the left-right direction as shown in FIG. 9A. Further, in the case of combining each operation of the four motors in the left-right direction, it is possible to reduce the magnitude of the operation of the pair of massage elements 321, 322 in the left-right direction by the range of not less than 50% and not less than 80% as shown in FIG. 9A. Subsequently, in the case of combining each operation of the four motors in the up-and-down direction, it is possible to reduce magnitude of the operation of the pair of massage elements 321, 322 in the up-and-down direction by the range of not less than 50% and not more than 80% as shown in FIG. 9B. Finally, in the case of combining each operation of the four motors in the front-back direction, it is possible to make magnitude of the operation of the pair of massage elements 321, 322 in the front-back direction zero as shown in FIG. 9C.

Figure 10:
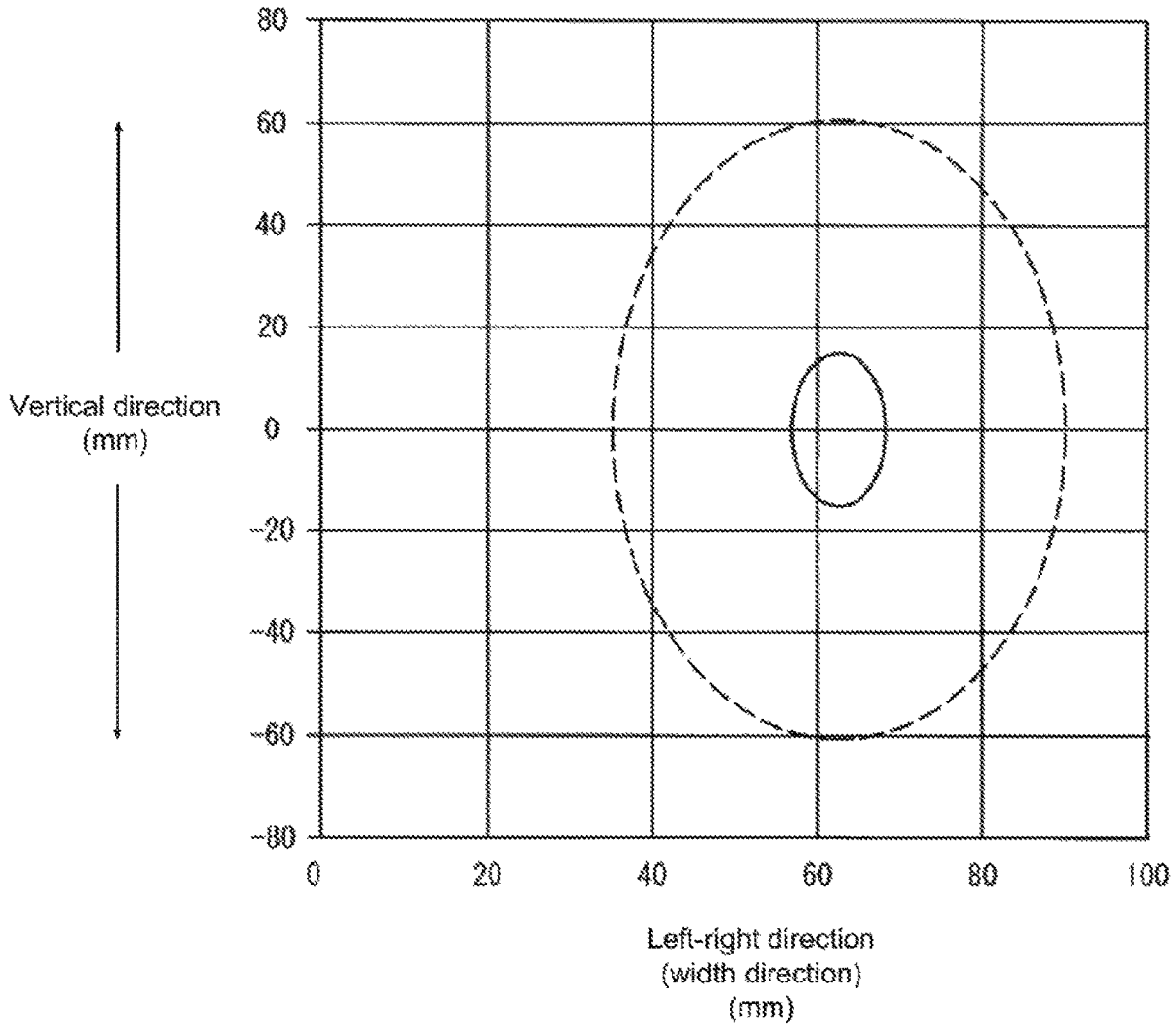
FIG. 10 is a schematic view showing one example of a locus of the pair of massage elements in the case where the four motors are operated.
Figure 11:
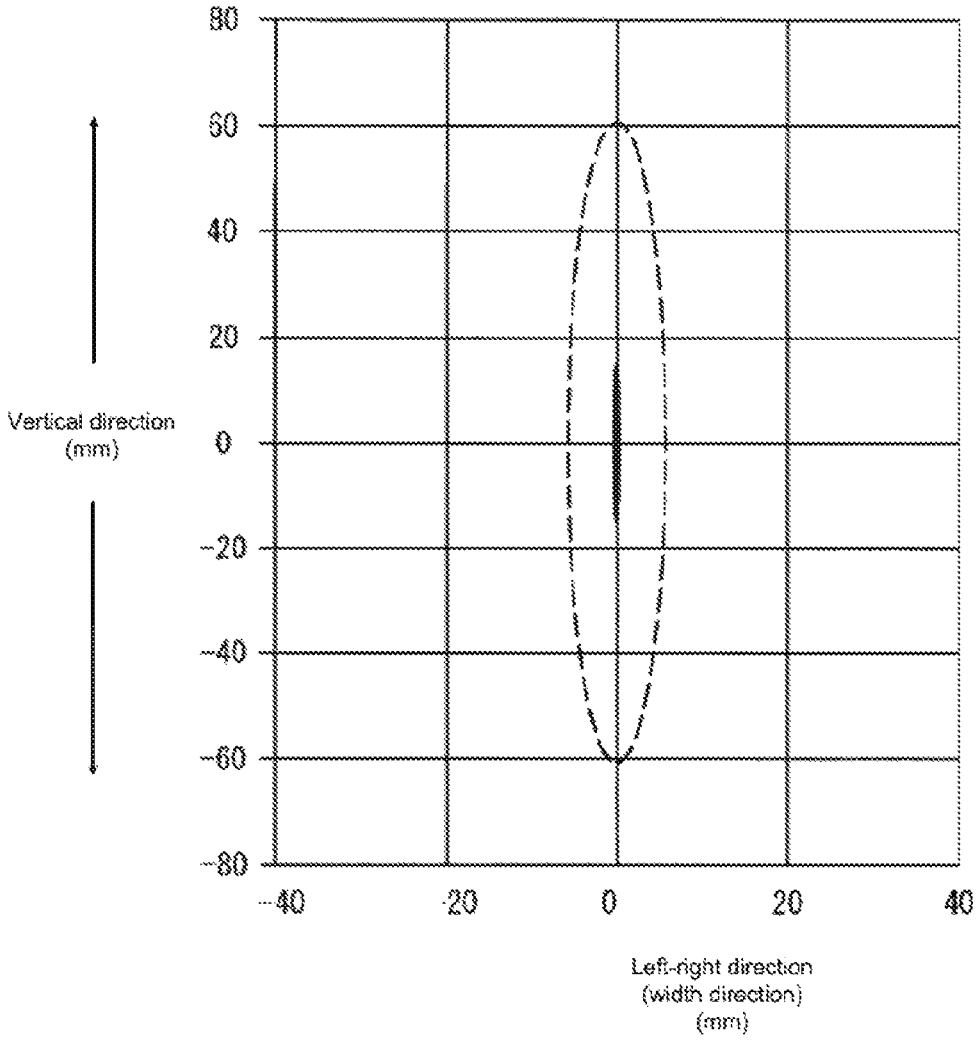
FIG. 11 is a schematic view showing another example of the locus of the pair of massage elements in the case where the four motors are operated.
Figure 12:
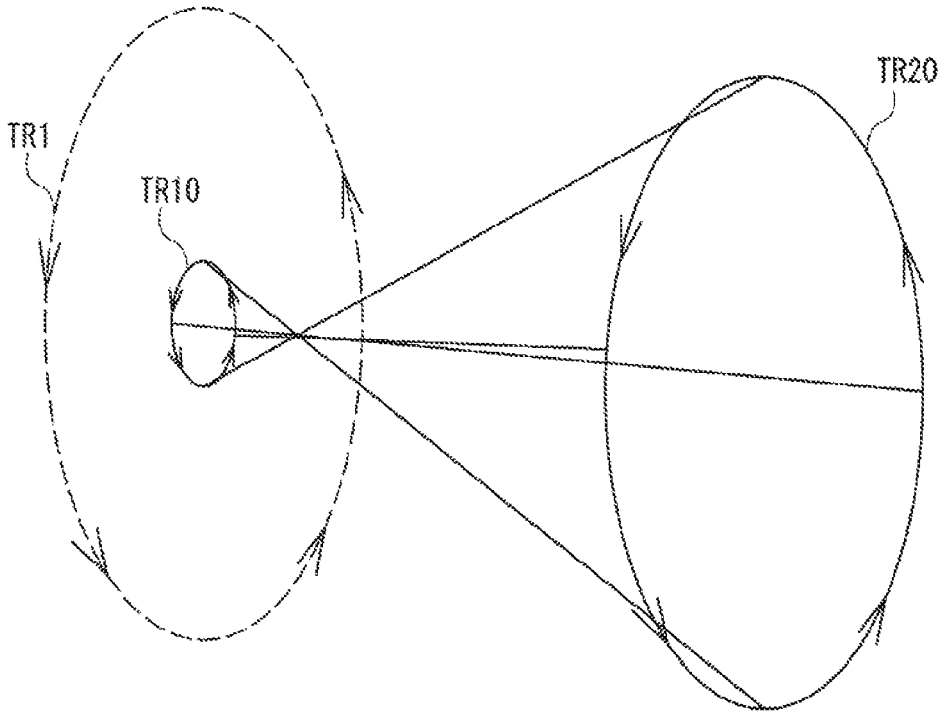
FIG. 12 is a schematic view showing one example of a moving locus of the massage elements in the case where the four motors are operated.

Each of FIGS. 10 and 11 is a schematic view showing one example of a locus of the pair of massage elements 321, 322 in the case where the four motors are operated. Further, FIG. 12 is a schematic view for explaining a moving locus of the center between the pair of massage elements 321, 322 in the case where the four motors are operated. A vertical axis of FIG. 10 represents a moving distance in the up-and-down direction and a horizontal axis of FIG. 10 represents a moving distance in the left-right direction. Further, a vertical axis of FIG. 11 represents the moving distance in the up-and-down direction and a horizontal axis of FIG. 11 represents a moving distance in the front-back direction.

Further, the solid line in each of FIGS. 10 and 11 represents the locus of the pair of massage elements 321, 322 in the case where the four motors are operated. The dotted line in each of FIGS. 10 and 11 represents the locus of the pair of massage elements 321, 322 in the case where only the kneading motor 331 is operated.

As shown in FIGS. 10 and 11, in the case where the four motors are operated, the pair of massage elements 321, 322 are not moved in the front-back direction, an amount of the change in the left-right direction reduces by 80% and an amount of the change in the up-and-down direction reduces by 80% compared with the case where only the kneading motor 331 is operated. As a result, the pair of massage elements 321, 322 are moved within a narrower area.

Further, in the case where only the kneading motor 331 is operated, the massage elements 321, 322 are moved along the dotted moving locus TR1 as shown in FIG. 12. On the other hand, in the case where the four motors are operated, the center EC of the eccentric pivot operation of the massage elements 321, 322 is moved along a moving locus TR20. As a result, in the case where the four motors are operated, the massage elements 321, 322 are moved along a moving locus TR10. The moving locus TR10 is formed within a narrower area than the moving locus TR1.

In the same manner as the case shown in FIG. 5 where only the kneading motor 331 is operated, the abutting angle of the pair of massage elements (massage balls) 321, 322 with respect to the body is changed along with the movement (the ellipse locus TR10) of the massage elements (massage balls) 321, 322 so as to be directed to a direction for pressing and stretching the treated part of the body of the person to be treated toward the outer side of the ellipse locus. Thus, it is possible to practice the so-called pressing and rubbing kneading for massaging so as to press and stretch the treated part of the person to be treated by moving of the massage elements (massage balls) 321, 322 to the same position within a narrow area as one example of the kneading operation.

Figure 13:
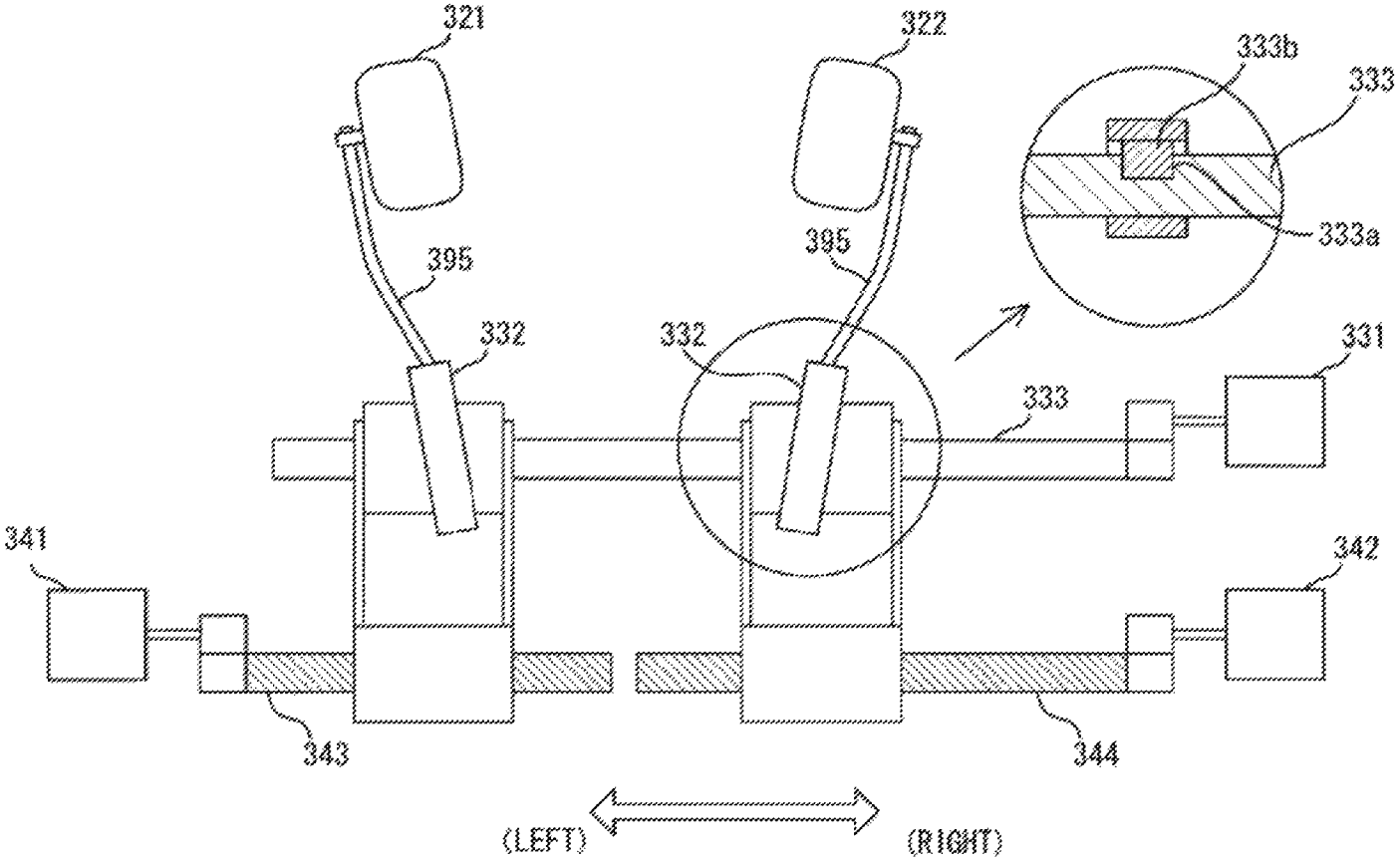
FIG. 13 is a schematic view showing one example of a kneading motor mechanism and a width adjustment mechanism.
Figure 14:
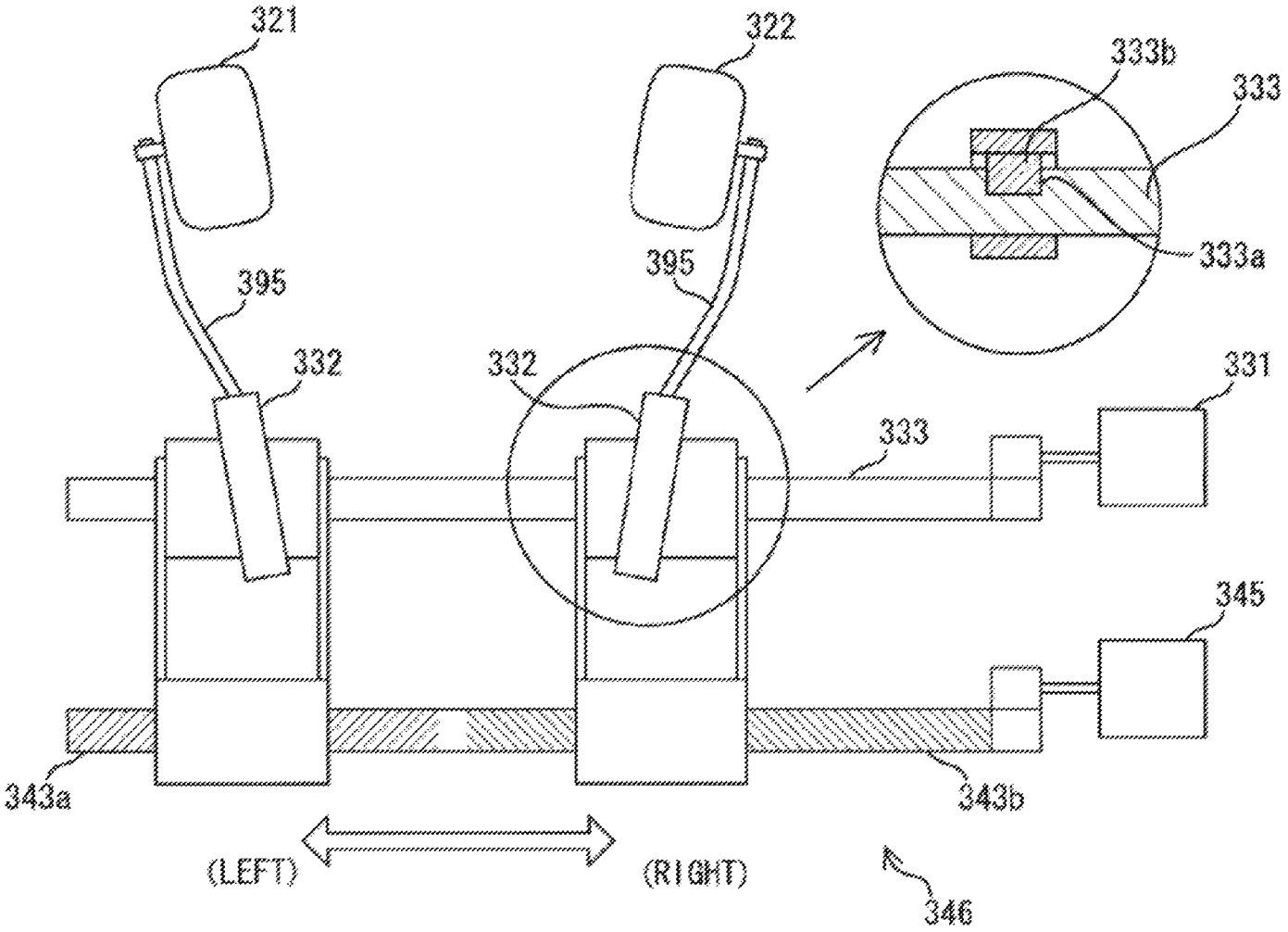
FIG. 14 is another schematic view showing the one example of the kneading motor mechanism and the width adjustment mechanism.

Next, each of FIGS. 13 and 14 is a schematic view showing one example of the kneading motor mechanism 330 and the width adjustment mechanism 340. In this embodiment, the eccentrically and pivotally moving body 332 for kneading is provided at the massage element 321 through a massage element arm 395 and slidably provided on the support axis 333 as shown in FIG. 13. In the same manner, the eccentrically and pivotally moving body 332 for kneading is provided at the massage element 322 through a massage element arm 395 and slidably provided on the support axis 333. Further, as shown in a detailed cross-sectional view, each of the pivotally moving body 332 for kneading the pair of massage elements 321, 322 has a convex portion 333*b* and is engaged with a key groove 333*a* formed so as to extend in a longitudinal direction of the support axis 333. This makes it possible to transmit the rotation of the kneading motor 331 to the pair of massage elements 321, 322 even in the case where the pair of massage elements 321, 322 are moved in the left-right direction. Thus, the pair of massage elements 321, 322 can perform the kneading operation when the kneading motor 331 rotates. Further, the width adjustment motor 341 for the massage element 321 of the width adjustment mechanism 340 rotates the axis 343. By rotating the axis 343, it is possible to move the massage element 321 in the left-right direction (the width direction) with a rack and pinion structure constituted of the axis 343 and a part of massage elements 321. Furthermore, the width adjustment motor 342 for the massage element 322 rotates the axis 344. By rotating the axis 344, it is possible to move the massage element 322 in the left-right direction (the width direction) with a rack and pinion structure constituted of the axis 344 and a part of the massage elements 322.

Although the configuration shown in FIG. 13 is used in this embodiment, the present invention is not limited thereto. It may be possible to use a configuration shown in FIG. 14. As shown in FIG. 14, it may be possible to use a slide axis 346 on which a normal screw portion 343*a* and a reverse screw portion 343*b* are formed and one width adjustment motor 345 instead of the width adjustment motor 341 for the massage element 321, the width adjustment motor 342 for the massage element 322 and the axis 343. In this case, by normally rotating the width adjustment motor 345, it is possible to widen the width between the pair of massage elements 321, 322. Further, by reversely rotating the width adjustment motor 345, it is possible to narrow the width between the pair of massage elements 321, 322. Namely, the width adjustment motor 345 can relatively change the width between the pair of massage elements 321, 322.

Figure 15:
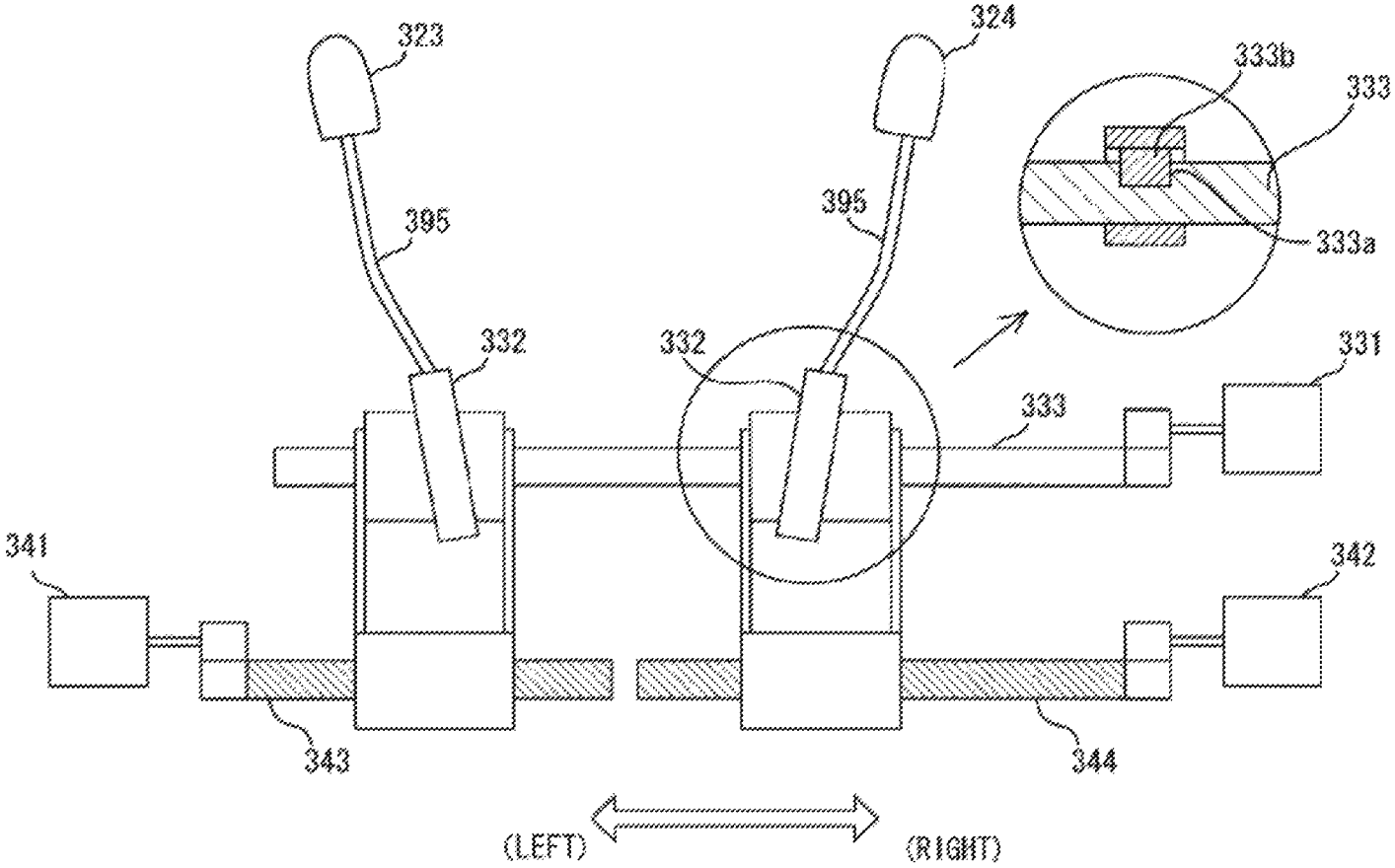
FIG. 15 is a schematic view showing another example of the massage elements.

Subsequently, FIG. 15 is a schematic view showing another example of the pair of massage elements 321, 322. With reference to FIG. 15, description will be given to points differing from the configuration of the pair of massage elements 321, 322 shown in FIG. 13. As shown in FIG. 15, each of a pair of massage elements 323, 324 does not have the kneading ball shape (the oval spherical shape) like the pair of massage elements 321, 322 and is constituted of a rod whose tip end is round (hereinafter, this rod is referred to as a rod-like massage element) having a shape and a size approximated to a shape and a size of a thumb of an adult.

A tip end portion of each of the rod-like massage elements 323, 324 shown in FIG. 15 preferably has a size equal to or less than 5 cm, and more preferably has a size equal to or less than 3 cm. Further, by using the rod-like massage elements 323, 324, it is possible to realize a massage which is more similar to thumb pressing and rubbing kneading of a hand of human. Further, although description is given to the case where a cross-sectional surface of each of the rod-like massage elements 323, 324 is a circular shape or an ellipse shape, the present invention is not limited thereto. The cross-sectional surface of each of the rod-like massage elements 323, 324 may be any shape such as a rectangular shape and a cylindrical shape, and the like.

Figure 16:
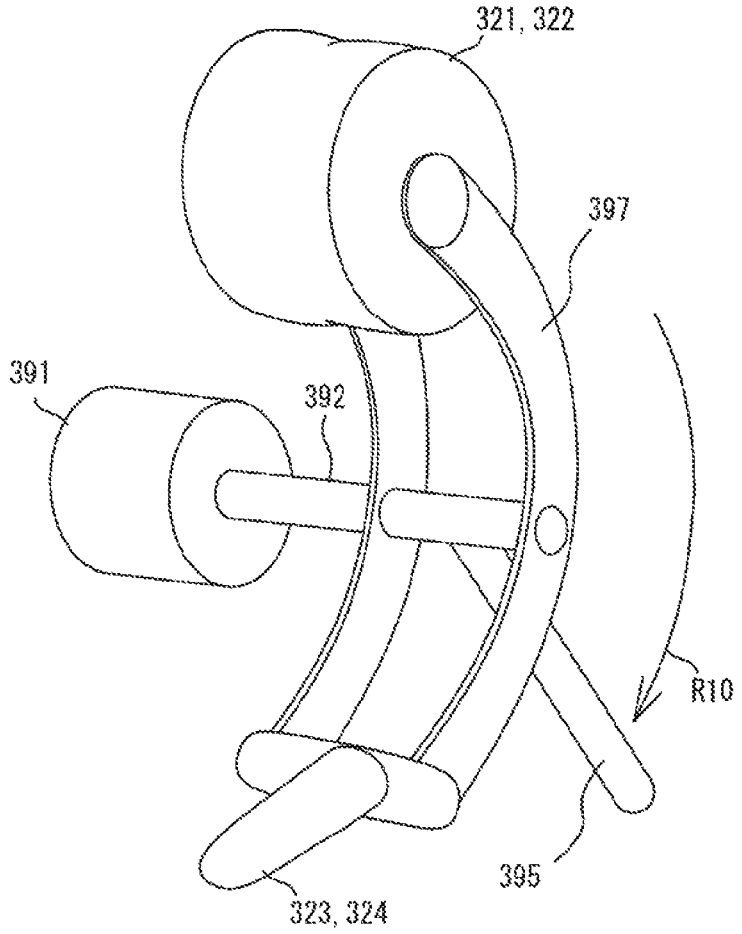
FIG. 16 is a schematic view showing an example of the pair of massage elements.

Finally, FIG. 16 is a schematic view showing an example of the pair of massage elements 321, 322, 323, 324.

As shown in FIG. 16, the pair of massage elements 321, 322 are constituted of members having the kneading ball shape. The kneading ball shape contains an oval spherical shape, a spherical shape and the like. On the other hand, the pair of massage elements 323, 334 are constituted of the rod-like massage elements described in FIG. 15. Further, the pair of massage elements 321, 322 and the pair of massage elements 323, 324 are respectively provided at end portions of a curved massage element connecting member 397. The massage element connecting member 397 is attached to an actuator 391 and a rotational axis 392.

When the actuator 391 normally rotates, the massage element connecting member 397 is moved toward a direction of an arrowed line R10. As a result, it is possible to allow the pair of massage elements 323, 324 to make contact with the body of the person to be treated. Further, when the actuator 391 reversely rotates, the massage element connecting member 397 is moved toward a direction opposed to the arrowed line R10. As a result, it is possible to allow the pair of massage elements 321, 322 to make contact with the body of the person to be treated. Further, the massage element arm 395 is attached to the massage element connecting member 397 as shown in FIG. 16. Thus, when the kneading motor 331 is operated, it is possible to provide a variety of massages with the pair of massage elements 321, 322 or the pair of massage elements 323, 324 to the person to be treated.

As described above, it is possible to easily switch between the massage with the massage balls of the conventional massage elements 321, 322 and the massage of the pressing and rubbing kneading with the rod-like massage elements of the massage elements 323, 324 shown in FIGS. 14 and 15.

As described above, in the seat-type massage machine 100 according to the present invention, it is possible to form the locus (the moving locus TR10) of the pair of massage elements 321, 322 within the narrower area due to the operations of the four motors compared with the locus of the pair of massage elements 321, 322 due to the normal kneading motor 331 with keeping the change of the abutting angle of the massage element arm with respect to the body caused by the eccentric pivot operation with respect to the kneading axis due to the kneading motor 331. Further, it is possible to form the smooth locus (the moving locus TR10) of the pair of massage elements 321, 322 within the narrower area by executing the operation of the opposite phase with respect to the phase of the operation of the pair of massage elements 321, 322 due to the kneading motor 331 with keeping the change of the abutting angle of the massage element arm with respect to the body caused by the eccentric pivot operation with respect to the kneading axis due to the kneading motor 331. As a result, it is possible to provide the so-called pressing and rubbing kneading to the person to be treated.

Further, the control part 800 can make the magnitude of the opposite phase be in the range of not less than 50% and not more than 100% of the magnitude of the phase. As a result, it is possible to move the massage elements 321, 322 in two directions among the three directions without moving the massage elements 321, 322 in the other one direction. Thus, it is possible to realize various kinds of pressing and rubbing kneading.

In this regard, in this embodiment, although the phase of each operation of the width adjustment motor 341 for the massage element 321, the width adjustment motor 342 for the massage element 322, the strength-and-weakness motor 351 and the up-and-down motor 361 is adjusted so as to be the opposite phase with respect to the phase of the operation of the kneading motor 331 by shifting the phase of each operation of these four motors by 180 degrees, the present invention is not limited thereto. The phase of each operation of these four motors may be adjusted so as to be a phase shifted by more than 90 degrees and less than 270 degrees. Even in this case, it is possible to form the locus of the pair of massage elements 321, 322 due to the kneading motor 331 within the narrower area in the case of increasing the amplitude of each movement of the motor whose phase has been shifted. In this regard, although the massage machine having the backrest portion is exemplified in the description for the seat-type massage machine 100 according to this embodiment, the present invention is not limited thereto. The present invention may be a bed-type massage machine and it is possible to apply the present invention to a massage machine for treating only a part of the body of the person to be treated.

(Correspondence Relationships Among Each Portion in the Embodiments and Each Constituent Element in the Claims)

In the present invention, each of the massage elements 321, 322, 323, 324 corresponds to "a massage element", each of the kneading motor mechanism 330 and the kneading motor 331 corresponds to "a kneading motor", the massage element arm 395 corresponds to "a massage element arm", the massage element connecting member 397 corresponds to "a massage element connecting member", each of the width adjustment mechanism 340, the width adjustment motor 341 for the massage element 321, the width adjustment motor 342 for the massage element 322 and the width adjustment motor 345 corresponds to "a width adjustment motor", each of the strength-and-weakness motor mechanism 350 and the strength-and-weakness motor 351 corresponds to "a strength-and-weakness motor", each of the up-and-down motor mechanism 360 and the up-and-down motor 361 corresponds to "an up-and-down motor", the control part 800 and the flow chart shown in FIG. 3 correspond to "a controlling step", each of FIGS. 4A and 6A to 8A corresponds to "movement in a width direction", each of FIGS. 4C and 6C to 8C corresponds to "movement in a front-back direction", each of FIGS. 4B and 6B to 8B corresponds to "movement in an up-and-down direction", the flow chart shown in FIG. 3 corresponds to "a control method for a massage machine", each of the pair of massage elements 323, 324 shown in FIGS. 15 and 16 corresponds to "a massage element of a massage machine", each of the pair of massage elements 323, 324 and the rod-like massage element corresponds to "a rod-like member", the shape of each of the pair of massage elements 321, 322 corresponds to "a kneading ball shape", the massage elements 321, 322 and the massage elements 323, 324 correspond to "plural kinds of massage elements" and the actuator 391 corresponds to "a pivotally moving device".

Although the preferred embodiment of the present invention is described above, the present invention is not limited thereto. It would be understood that a variety of embodiments can be practiced without departing from the spirit and scope of the present invention. Further, the functions and effects provided by the configuration of the present invention have been described in this embodiment, these functions and effects are merely one example and do not limit the present invention.

Further, in recent years, there has been a growing trend from a person to be treated that a massage machine should provide various kinds of treatment.

It is a primary object of the present invention to provide a control method for a massage machine and a massage element of a massage machine which can provide pressing-and-rubbing kneading to a person to be treated. It is another object of the present invention to provide a control method for a massage machine and a massage element of a massage machine which can provide the pressing-and-rubbing kneading to the person to be treated with a massage machine using a massage unit which can realize a kneading operation by allowing a massage element to perform an eccentric pivot operation with respect to a kneading axis.

In this regard, the words of "pressing and rubbing kneading" mean a treatment method in which each of the massage elements is rotationally moved so as to draw a small circle in a state that the massage element is pressed onto a stiffness part of a muscle to partially add pressure. In this treatment method, the time of drawing the circle, it is preferable that the massage element is moved so as to add pressure to a body surface in an outer direction of the circle with adding pressure to the body surface in a direction perpendicular to the body surface to press and stretch a treated part toward an outer side. This pressing and rubbing kneading can be realized by the eccentric pivot operation with respect to the kneading axis and an interlocking control among a width adjustment mechanism, a front-back movement mechanism and an up-and-down movement mechanism.

A control method for a massage machine according to one aspect comprises a controlling step for individually controlling operations of a kneading motor for eccentrically and pivotally moving a pair of massage elements of the massage machine, a width adjustment motor for adjusting a width between the pair of massage elements, a strength-and-weakness motor for adjusting front-back movement of the pair of massage elements and an up-and-down motor for adjusting up-and-down movement of the pair of massage elements. The controlling step operates the massage elements so that movement of the massage elements in a width direction thereof due to the width adjustment motor is directed to a reverse direction with respect to movement of the massage elements in the width direction thereof due to the kneading motor, movement of the massage elements in a front-back direction due to the strength-and-weakness motor is directed to a reverse direction with respect to movement of the massage elements in the front-back direction due to the kneading motor, and movement of the massage elements in an up-and-down direction due to the up-and-down motor is directed to a reverse direction with respect to movement of the massage elements in the up-and-down direction due to the kneading motor.

In this case, with keeping a change of an abutting angle of a massage element arm with respect to a body caused by an eccentric pivot operation with respect to a kneading axis due to the kneading motor, it is possible to form a locus of the pair of massage elements within a narrower area due to the operations of the kneading motor, the width adjustment motor, the strength-and-weakness motor and the up-and-down motor compared with a locus of the pair of massage elements due to a normal kneading motor. As a result, it is possible to provide the so-called pressing and rubbing kneading to the person to be treated.

Further, although the locus of the pair of massage elements due to a conventional kneading motor is three dimensions, it is possible to move the locus of the pair of massage elements in two dimensions or fix the locus of the pair of massage elements at one point to add force from all directions by further using the control method for the massage machine according to the present invention. As a result, it is possible to provide a massage such as the so-called pressing and rubbing kneading to the person to be treated with curved surfaces of the massage elements. In addition, by further using a control method due to the conventional kneading motor, it is possible to provide a more variety of massages to the person to be treated.

A control method for a massage machine of a second present invention according to the control method for the massage machine of the one aspect, wherein the controlling step may adjust the movement of the massage elements in the width direction thereof due to the width adjustment motor so as to be an opposite phase with respect to a phase of the movement of the massage elements in the width direction thereof due to the kneading motor, the movement of the massage elements in the front-back direction due to the strength-and-weakness motor so as to be an opposite phase with respect to a phase of the movement of the massage elements in the front-back direction due to the kneading motor, and the movement of the massage elements in the up-and-down direction due to the up-and-down motor so as to be an opposite phase with respect to a phase of the movement of the massage elements in the up-and-down direction due to the kneading motor.

In this case, with keeping the change of the abutting angle of the massage element arm with respect to the body caused by the eccentric pivot operation with respect to the kneading axis due to the kneading motor, it is possible to form a smooth locus of the pair of massage treatments within a narrower area by executing an operation of an opposite phase with respect to a phase of an operation of the pair of massage elements due to the kneading motor.

A control method for a massage machine of a third present invention according to the control method for the massage machine of the second present invention, wherein the controlling step may adjust magnitude of amplitude of the opposite phase to fall within the range of not less than 50% and not more than 100% of magnitude of amplitude of the phase.

In this case, the controlling step can make the magnitude of the amplitude of the opposite phase be in the range of not less than 50% and not more than 100% of the magnitude of the amplitude of the phase. As a result, it is possible to various kinds of movement such as movement for not moving the pair of massage elements in one direction and moving the pair of massage elements in other two directions. Thus, it is possible to realize various kinds of pressing and rubbing kneading.

A massage element of a massage machine according to yet another present invention comprises a massage element constituted of a rod-like member having a size approximated to a size of a finger of a human.

In this case, the massage element is constituted of not a member having an oval spherical shape or a spherical shape, which is a conventional massage ball, but the rod-like member having the size approximated to the size of the finger of the human. Specifically, the size of the rod-like member is preferably equal to a size of a thumb or an index finger of the human. Specifically, it is more preferable that the rod-like member has a curved shape of a ball of a finger whose tip end portion has a size of 5 cm or less or a curved shape of a ball of a finger whose tip end portion has a size of 3 cm or less. Further, the rod-like member may contain a semispherical body whose tip end portion has a size of $\phi 3$ cm or less. Further, the rod-like member may have a massage rod shape used for pressing a sole of a foot and it is preferable that a length of the rod-like member is equal to a diameter of the oval spherical shape or the spherical shape of the massage ball.

A massage element of a massage machine of an eighth present invention according to the massage element of the massage machine of the seventh present invention, wherein the massage element may have a plurality of massage elements, one of the massage elements may have a kneading ball shape, each of the others of the massage elements may be constituted of the rod-like member, and the massage element having the kneading ball shape and the massage elements each constituted of the rod-like member may be connected with each other by a massage element connecting member.

In this case, since the massage element having the kneading ball shape (such as an oval spherical shape, a spherical shape and a tire-shape) and each massage element constituted of the rod-like member are connected with each other by the massage element connecting member, it is possible to provide a massage with the massage element having the kneading ball shape and a massage with each massage element constituted of the rod-like member to the person to be treated.

A massage element of a massage machine of a ninth present invention according to the massage element of the massage machine of the eighth present invention, further comprises a pivotally moving device, wherein the massage element connecting member may be connected to the pivotally moving device.

In this case, the pivotally moving device is pivotally moved to move the massage element connecting member. As a result, one of the massage element having the kneading ball shape and the massage element constituted of the rod-like member is selected, thereby allowing the selected one to make contact with the person to be treated. As a result, it is possible to select one of the massage element having the kneading ball shape and the massage element constituted of the rod-like member by normally rotating or reversely rotating the pivotally moving device. Further, since the massage element connecting member is connected to the massage element arm, it is possible to provide the massage with one of the massage element having the kneading ball shape and the massage element constituted of the rod-like member by utilizing movement of the kneading motor.

A control method for a massage machine according to another aspect comprises a controlling step for controlling an actuator operating a massage element connecting member to which plural kinds of massage elements are attached, wherein the controlling step performs by driving the actuator to pivotally move the massage element connecting member in one direction in a case where one of the plural kinds of massage elements is selected and driving the actuator to pivotally move the massage element connecting member in a direction opposite to the one direction in a case where the other one of the plural kinds of massage elements is selected.

What is claimed is:

1. A control method for a massage machine, comprising:

a controlling step for individually controlling operations of a kneading motor for eccentrically and pivotally moving a pair of massage elements of the massage machine, a width adjustment motor for adjusting a width between the pair of massage elements, a strength-and-weakness motor for adjusting front-back movement of the pair of massage elements and an up-and-down motor for adjusting up-and-down movement of the pair of massage elements, wherein the controlling step operates the massage elements so that:

movement of the massage elements in a left-right direction thereof due to the width adjustment motor is directed to a right-left direction with respect to movement of the massage elements in the left-right direction thereof due to the kneading motor, movement of the massage elements in a front-back direction due to the strength-and-weakness motor is directed to a back-front direction with respect to movement of the massage elements in the front-back direction due to the kneading motor, and movement of the massage elements in an up-and-down direction due to the up-and-down motor is directed to a down-and-up direction with respect to movement of the massage elements in the up-and-down direction due to the kneading motor;

wherein when a control part simultaneously performs operation of controlling the kneading motor, the width adjustment motor, the strength-and-weakness motor and the up-and-down motor, the massage elements are moved along a narrower moving locus than a moving locus when each of the kneading motor, the width adjustment motor, the strength-and-weakness motor and the up-and-down motor is operated individually;

wherein the controlling step further adjusts:

the movement of the massage elements in the left-right direction thereof due to the width adjustment motor so as to be a right-left phase with respect to a phase of the movement of the massage elements in the left-right direction thereof due to the kneading motor, the movement of the massage elements in the front-back direction due to the strength-and-weakness motor so as to be a back-front phase with respect to a phase of the movement of the massage elements in the front-back direction due to the kneading motor, and the movement of the massage elements in the up-and-down direction due to the up-and-down motor so as to be a down and up phase with respect to a phase of the movement of the massage elements in the up-and-down direction due to the kneading motor;

wherein the controlling step adjusts:

magnitude of amplitude of the right-left phase to fall within a range of not less than 50% and not more than 90% of magnitude of amplitude of the phase of the movement of the massage elements in the left-right direction thereof due to the kneading motor;

magnitude of amplitude of the back-front phase to fall within a range of not less than 50% and not more than 100% of magnitude of amplitude of the phase of the movement of the massage elements in the front-back direction due to the kneading motor; and magnitude of amplitude of the down and up phase to fall within a range of not less than 50% and not more than 90% of magnitude of amplitude of the phase of the movement of the massage elements in the up-and-down direction due to the kneading motor.

2. A control method for a massage machine comprising:

a controlling step for individually controlling operations of a kneading motor for eccentrically and pivotally moving a pair of massage elements of the massage machine, a width adjustment motor for adjusting a width between the pair of massage elements, the pair of massage elements in the width direction being actuated via a lead screw that comprises a first screw portion and a second reverse screw portion, wherein the first screw portion and second screw portion allow the pair of massage elements to be moved toward and away from each other, a strength-and-weakness motor for adjusting front-back movement of the pair of massage elements and an up-and-down motor for adjusting up-and-down movement of the pair of massage elements, wherein the controlling step operates the pair of massage elements so that:

a movement between the pair of massage elements in the width direction by the width adjustment motor is opposite to the movement in the width direction of the pair of massage elements by the kneading motor, a movement of the pair of massage elements in the front-back direction by the strength-and-weakness motor is opposite to the movement in the front-back direction of the pair of massage elements by the kneading motor, a movement of the pair of massage elements in the up-and-down direction by the up-and-down motor is opposite to the movement in the up-and-down direction of the pair of massage elements by the kneading motor, whereby when left-right operations of the kneading motor and the width adjustment motor are combined, a magnitude of left-right movement of the pair of massage elements is reduced, when up-and-down operations of the kneading motor and the up-and-down motor are combined, a magnitude of the up-and-down movement of the pair of massage elements is reduced, wherein each operation of the kneading motor, the width adjustment motor, the strength-and-weakness motor, and the up-and-down motor performed simultaneously to suppress a magnitude of the front-back movement of the pair of massage elements, wherein a maximum diameter of circular locus or ellipse locus of the left-right movement, the up-and-down movement, and the front-back movement of each of the pair of massage elements is reduced and, a direction of an abutting angle of the pair of massage elements, with respect to a body of a person to be treated, is changed to a press and stretch direction to press and stretch a treated part of the body of a person to be treated toward an outer side of the circular locus or the ellipse locus, to provide a pressing and rubbing kneading massage.

3. A massage machine comprising:

a controlling step for individually controlling operations of a kneading motor for eccentrically and pivotally moving a pair of massage elements of the massage machine, a width adjustment motor for adjusting a width between the pair of massage elements, the pair of massage elements in the width direction being actuated via a lead screw that comprises a first screw portion and a second reverse screw portion, wherein the first screw portion and second screw portion allow the pair of massage elements to be moved toward and away from each other, a strength-and-weakness motor for adjusting front-back movement of the pair of massage elements and an up-and-down motor for adjusting up-and-down movement of the pair of massage elements, wherein the controlling step operates the pair of massage elements so that:

a movement between the pair of massage elements in a width direction by the width adjustment motor is opposite to the movement in the width direction of the pair of massage elements by the kneading motor, a movement of the pair of massage elements in a front-back direction by the strength-and-weakness motor is opposite to the movement in the front-back direction of the pair of massage elements by the kneading motor, a movement of the pair of massage elements in a up-and-down direction by the up-and-down motor is opposite to the movement in the up-and-down direction of the pair of massage elements by the kneading motor, whereby when left-right operations of the kneading motor and the width adjustment motor are combined, a magnitude of left-right movement of the pair of massage elements is reduced, when up-and-down operations of the kneading motor and the up-and-down motor are combined, a magnitude of the up-and-down movement of the pair of massage elements is reduced, wherein each operation of the kneading motor, the width adjustment motor, the strength-and-weakness motor, and the up-and-down motor are performed simultaneously to suppress a magnitude of the front-back movement of the pair of massage elements, wherein maximum diameter of circular locus or ellipse locus of the left-right movement, the up-and-down movement, and the front-back movement of each of the pair of massage elements is reduced and, a direction of an abutting angle of the pair of massage elements, with respect to a body of a person to be treated, is changed to a press and stretch direction to press and stretch a treated part of the body of a person to be treated toward an outer side of the circular locus or the ellipse locus, to provide a pressing and rubbing kneading massage.

4. The massage machine as set forth in claim 3, wherein each massage element of the pair of massage elements has a kneading ball shape member and a rod shape member, the kneading ball shape member and rod shape member being connected by a massage element connecting member;

wherein the massage element connecting member pivots the kneading ball shape member toward the user while moving the rod shape member away from the user or the massage element connecting member pivots the rod shape massage element toward the user while moving the kneading ball shape massage element away from the user, wherein the pair of massage elements of the massage machine further comprising a pivotally moving device, wherein the massage element connecting member is perpendicularly connected to the pivotally moving device.

5. The massage machine as set forth in claim 4, wherein the massage element connecting member is curved shaped.

* * * * *